United States Patent [19]

Bean

[11] 4,244,384

[45] Jan. 13, 1981

[54] MODULAR SHELTER SYSTEM

[76] Inventor: Garnet S. Bean, 12655 Limekiln Rd., Fulton, Md. 20759

[21] Appl. No.: 18,104

[22] Filed: Mar. 7, 1979

[51] Int. Cl.[3] ..... A45F 1/16; E04B 1/12

[52] U.S. Cl. ..... 135/4 R; 52/63

[58] Field of Search ..... 135/4 R, 7 R; 52/63

[56] References Cited

U.S. PATENT DOCUMENTS

| | | | |
|---|---|---|---|
| 609,553 | 8/1898 | Lloyd | 135/4 R |
| 1,958,296 | 5/1934 | Crow | 135/4 R |
| 2,856,942 | 10/1958 | Scott | 135/4 R |
| 2,960,993 | 11/1960 | Holmstrom | 135/4 R |

FOREIGN PATENT DOCUMENTS

| | | | |
|---|---|---|---|
| 2140423 | 2/1973 | Fed. Rep. of Germany | 135/4 R |
| 1281038 | 11/1961 | France | 52/80 |
| 806170 | 12/1958 | United Kingdom | 135/4 R |

*Primary Examiner*—Alfred C. Perham
*Attorney, Agent, or Firm*—Morton J. Rosenberg

[57] ABSTRACT

A modular shelter system (10) used for the purpose of providing a substantial internal volume insulated from external environmental conditions. The modular shelter system (10) includes at least a pair of base members (12) having base rod support mechanisms (24) mounted in releasable fashion thereto. Support mechanisms (34) joined each to the other and to base members (12) provide for a generally hemispherical envelope. Support mechanisms (34) are coupled each to the other in releasable fashion and in a pivotal manner in order that they may be folded in contiguous mounting each to the other for compact storage and/or transportation. The support mechanisms (34) are secured to covering member (102) which is mounted on top of the generally hemispherical envelope provided by the mounted support mechanisms (34).

18 Claims, 9 Drawing Figures

FIG. 1
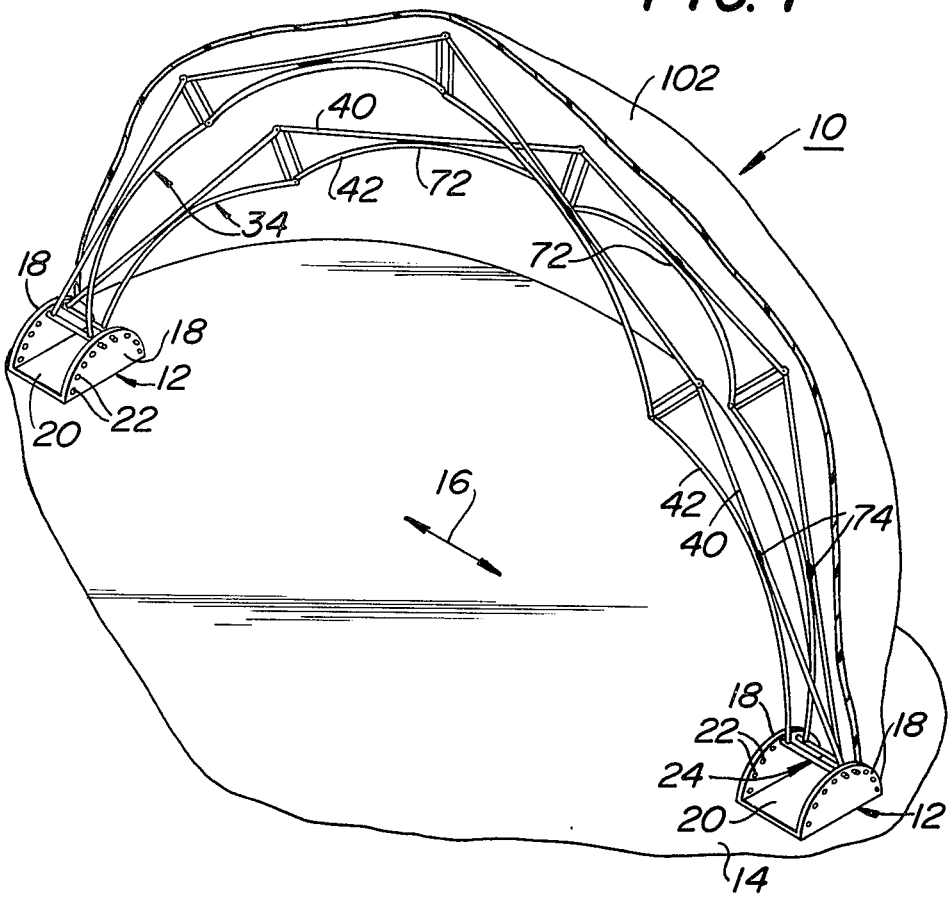
FIG. 3
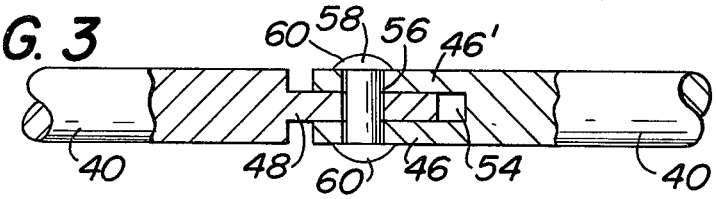
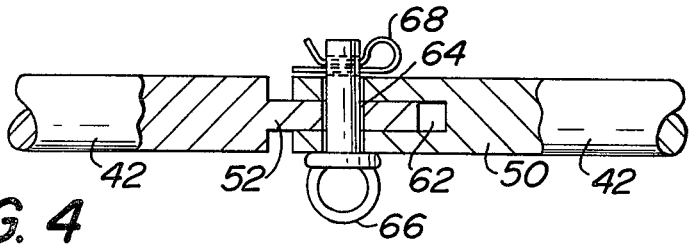
FIG. 4

MODULAR SHELTER SYSTEM

BACKGROUND OF THE INVENTION

1. Field of the Invention

This invention pertains to building structures. In particular, this invention relates to building structures of the type which are utilized for shelter. Still further, this invention pertains to building structures which are modular in nature. Further, this invention relates to building structures formed of supporting mechanisms which may be folded one on top of the other in one or two axes. Additionally, this invention relates to modular shelter systems which may be constructed in a minimum amount of labor time using a low degree of expertise in the building systems art.

2. Prior Art

Portable shelter assemblies are known in the art. The best prior art known to the applicant includes U.S. Pat. Nos. 3,715,843; 3,555,754; 3,683,427; 3,930,344; 3,888,056; 3,889,698; 4,091,584; 4,074,682; and, 3,766,573.

In some of the prior art such as that shown in U.S. Pat. No. 3,555,754, a portable shelter assembly is utilized for protecting workers during cold weather. In such prior art, the overall contour is formed in a box-like shape through standard structural mounting members. Covering sheets are provided, however, the external peripheral support structure does not provide for the ease of construction, as is necessary to the inventive concept of the subject invention. The overall structure contour does not provide for a maximum of internal volume when taken with respect to the support materials used.

In some prior dome-like systems, such as that shown in U.S. Pat. No. 3,683,427, the support cover may be formed of a flexible sheet. However, such prior systems do not provide for the interfitting structural components which allow foldability and compactness, as is provided in the subject invention concept.

In other prior art, sheltering systems do not allow for the construction of an entire dome system around two basic base members, which may be placed on an inclined surface as well as a horizontally planar base surface. This has the restriction of only allowing a positional location of the building structures in particular areas.

Other prior art systems do not allow for a simple easily constructed building which may be put up in a short amount of time with persons who do not have expertise in the particular construction process.

SUMMARY OF THE INVENTION

A modular shelter system which includes at least a pair of base members adapted to be locationally mounted on a base surface. Base members are located on opposing sides of the shelter system. The modular system includes support mechanisms which are releasably coupled to each of the base members and provide a substantially hemispherical support contour envelope. The support mechanisms are foldable one upon the other. The system further includes a covering member which is adapted to be mounted on the support mechanisms and releasably securable to the support mechanisms.

BRIEF DESCRIPTION OF THE DRAWINGS

FIG. 1 is an isometric view partially cut-away of the modular shelter system;

FIG. 3 is a cross-sectional view taken along the section line 3—3 of FIG. 2 showing the releasable securement of one support mechanism to a secondary support mechanism;

FIG. 4 is a cross-sectional view taken along the section line 4—4 of FIG. 2 showing a pivotal mounting of one support mechanism to a next adjacently located support mechanism;

DESCRIPTION OF THE PREFERRED EMBODIMENTS

Figures 2, 5:
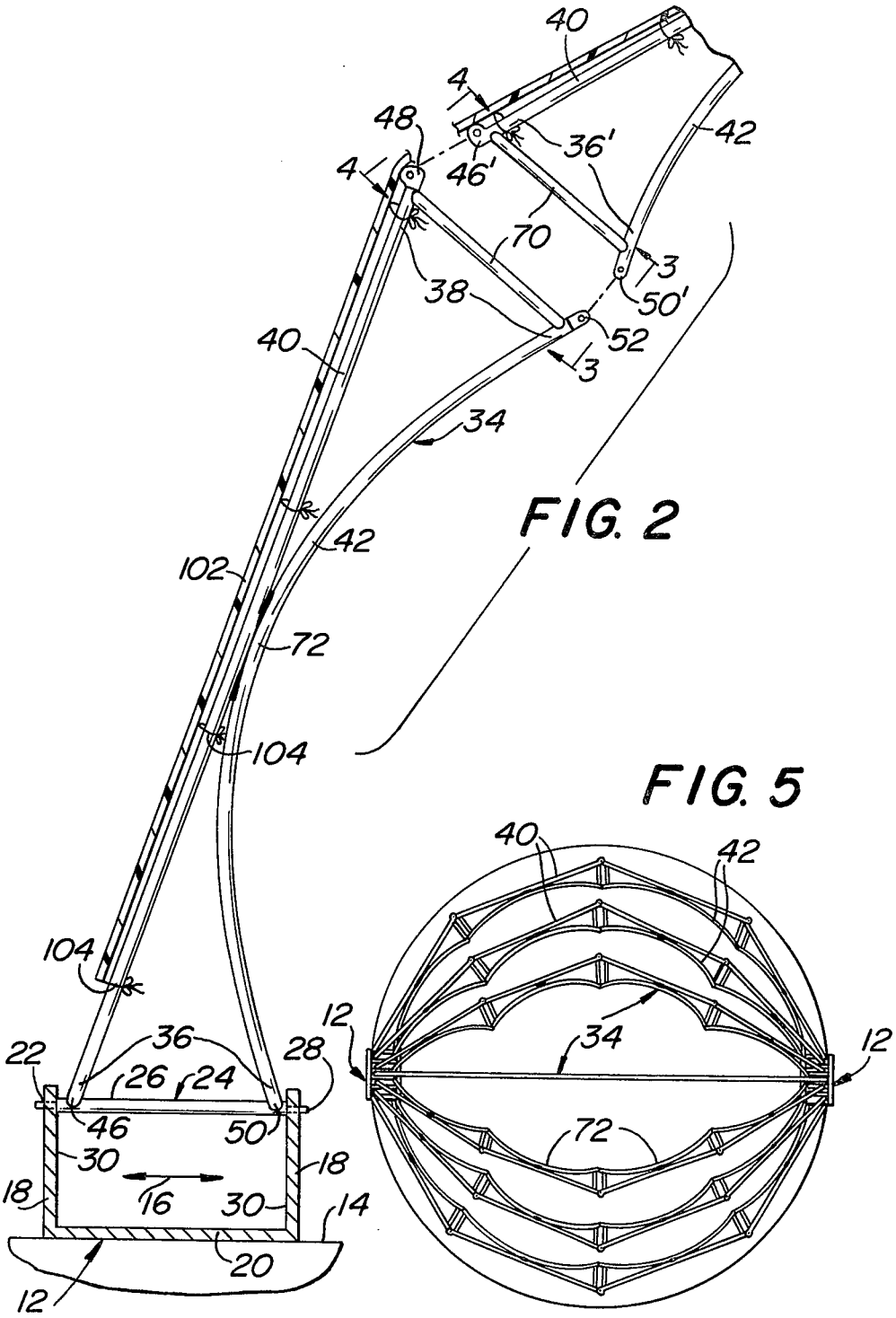
FIG. 2 is an elevational view of a support mechanism joined to a base member section of the modular shelter system.
FIG. 5 is a plane view of the modular shelter system shown in FIG. 1.

Referring now to FIGS. 1–9, there is shown modular shelter system 10 for use in providing shelter from the ambient atmospheric environment over a large internal volume. In general, modular shelter system 10 is particularly useful in the construction industry during the building and fabrication of edifice foundations and even in the initial construction phases of the frames of such edifices. The enclosed volume may be heated to maintain the ground conditions within system 10 to be above the freezing point and allow digging or other necessary construction work to be accomplished therein. In this manner, system 10 has the advantage of allowing construction work to be continued in a non-interrupting manner during weather which has previously terminated construction for long periods of time. Thus, the construction costs for an edifice may be significantly reduced through utilization of shelter system 10.

One of the important concepts of modular shelter system 10 is that it be applicable to non-level construction sites. The particular design and concept of system 10, as will be described in following paragraphs, is particularly directed to an overall structure which may be mounted on base members widely displaced each from the other, but allowing support of the enclosing system. Thus, system 10 may be mounted on a ground area which is inclined, or otherwise non-horizontal in planar contour.

Additionally, modular system 10 is so provided utilizing elements where inexperienced workers may erect shelter system 10 in a relatively short period of time. Construction materials and structures within system 10 are particularly adapted for compactness. As will be seen in following paragraphs, system 10 allows for folding of various structural components to provide the entire system within a small volume when not in use. Additionally, the load bearing members are particularly adapted for lightweight construction and thus, a minimum amount of labor is needed in the transport and erection phase of system 10.

Further, shelter system 10 utilizes a repetitive structural component concept. The repetitive structural component make-up of system 10 allows for reduced costs in the manufacturing stage.

Although shelter system 10 is directed in general to large areas such as providing an internal diameter approximating perhaps sixty feet, system 10 is easily applicable to greenhouse structure constructions, coverings for vehicles, coverings and shelter for gardens, and swimming pools, as well as a number of other uses.

The component structure of shelter system 10 is envisioned to be provided without a vertically directed center support which is found in a number of other shelter structures. Although a center vertically directed support may be used for additional load bearing capabilities, the overall concept of system 10 as herein provided does not rely or necessitate the use of a center support structure due to the fact that one of the basic concepts of the subject invention is to allow free movement within the internal volume of system 10. The free internal volume is generally necessitated by the fact that construction workers must dig a foundation or otherwise use the entire internal volume for various construction work phases.

Referring now to FIGS. 1, 2, 5, 8 and 9, it is seen that modular shelter system 10 includes at least a pair of base members 12 which are adapted to be locationally mounted on base surface 14. Base members 12 as can be seen in FIG. 1 are generally located on opposing sides of shelter system 10. In particular, base members 12 are displaced each from the other in lateral direction 16, as defined by the directional arrows shown in FIGS. 1, 2 and 8.

Base members 12 are U-shaped in contour, as is seen from the cross-section provided in FIG. 2. Each of base members 12 include a pair of laterally displaced base member sidewalls 18 and base floor member 20 secured either in one piece formation, or through bolting to laterally displaced base member sidewalls 18. As can be seen in FIGS. 1 and 2, base floor member 20 is generally planar in contour and is adapted to be locationally mounted on base surface 14 in a removable manner. It is to be understood that base floor member 20 will be maintained in a relatively stable locational position when in use due to the overall load bearing structure comprising modular shelter system 10. Base floor member 20, as well as base member sidewalls 18 may be formed of a metal construction material, such as steel, aluminum, or some like structurally sturdy material not important to the inventive concept as is herein described, with the exception that the components of base member 12 have structural integrity sufficient to maintain the loads bearing thereon.

Each of base member sidewalls 18 include a plurality of through openings 22. Openings 22 in one of base member sidewalls 18 are aligned in lateral displacement from openings 22 in the other of the base member sidewalls 18. In the preferred embodiments shown in FIGS. 1, 2, and 8, sidewall through openings 22 describe a semi-circular contour to permit various structural elements to be described in following paragraphs to be maintained at substantially equivalent lengths.

System 10 includes a plurality of base rod support mechanisms 24 which are secured to truss structures to be described in following paragraphs, as well as to base member sidewalls 18. Base rod support mechanisms 24 extend in lateral direction 16 through pairs of aligned openings 22 formed through opposing base member sidewalls 18.

Each of base rod support mechanisms 24 is formed of first rod support member 26 and second rod support member 28, each of which is extended in lateral direction 16 when in use. First rod support member 26 extends in lateral direction 16 substantially between an inner surface 30 of each of base member sidewalls 18. The extended lateral length of first rod support members 26 is less than the lateral displacement of base member sidewalls 18 for purposes to be discussed in following paragraphs. Additionally, each first rod support member 26 includes an axially directed lateral through opening 32. First rod support members 26 include an external diameter greater than sidewall through openings 22 in order that first rod support members 26 may not pass therethrough.

Each base rod support mechanism 24 includes second rod support member 28 which has an extended length greater than the lateral displacement of opposing base member sidewalls 18. The diameter of second rod support members 28 is substantially equal to, but slightly less than, the diameter of first rod support member through openings 32. In this manner, second rod support members 28 are insertable through sidewall through openings 22 and within through openings 32 of first rod support members 26.

Referring now to FIGS. 1 and 2, it is seen that support mechanisms 34 are releasably coupled to each of base members 12 and generally provide a substantially hemispherical support contour envelope. Support mechanisms 34 interface with base members 12 through base rod support mechanisms 24, as is clearly seen in FIG. 2. As will be described, support mechanism 34 are captured between base rod support mechanisms 24 and inner surfaces 30 of base member sidewalls 18.

Due to the difference in diameter of first rod support member 26 and second rod support member 28, there is provided a shoulder within which support mechanism first end section 36 is constrained between the first rod support member 26 and inner surface 30 of base member sidewall 18. First end section 36 includes a through opening of sufficient diameter within which second rod support member 28 may be slidably inserted. Thus, construction of support mechanism 34 in an interfacing relation to base member 12 is a simplified task.

Initially, first rod support member 26 is inserted in aligned fashion with a pair of displaced sidewall through openings 22. Support mechanism first end section 36 is aligned with through opening 32 of first rod support member 26. Second rod support member 28 is slidably inserted within first rod support member through opening 32 and support mechanism 34 is captured between first rod support member 26 and base member sidewall inner surfaces 30. In this simplified procedure, second end section 38 of support mechanism 34 is then adapted to be joined to a next successive support mechanism 34 at an adjacent first end section 36', as shown in FIG. 2.

As can be clearly seen in FIGS. 1 and 5, support or truss mechanism 34 includes a plurality of sectionally interfacing structures. Each of the structurally interfacing structures includes first strut rod 40, which is linearly directed and includes first end 46 coupled to base member 12 and second end 48 which is adapted to be coupled to first end 48′ of a next successive first strut rod 40.

Second strut rod 42 is generally curvilinearly directed and includes first end 50 adapted to be coupled to base member 12 and second end 52 adapted to be connected or coupled to first end 50′ of a next successive second strut rod 42.

Figure 6:
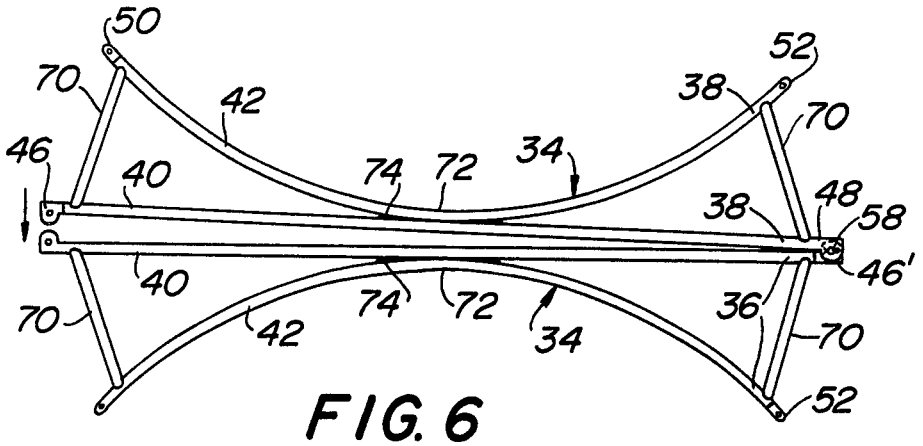
FIG. 6 is an elevational view of a pair of support mechanisms folded one upon the other.

The elemental coupling for adjacently located support mechanisms 34 which permits foldability as is shown in FIG. 6 is detailed in FIGS. 3 and 4. As is seen in FIG. 3, linearly directed first strut rods 40 may be interfaced in a tongue-in-groove type mating interface. As is seen, first strut rod second end 48 extends within groove 54 in a next adjacently located first strut rod 40. First strut rod second end 48 is thus inserted within a next adjacently located first strut rod 40 first end 46. Each of first strut rod second end 48 and first strut rod first ends 46 include through openings 56 which are aligned to allow passage therethrough of rivet 58. Rivet heads 60 have a substantially greater diameter than through opening 56 and thus, prevent removal of first strut rods 40 when rivet member 58 is placed in a positional location, shown in FIG. 3. In this manner, adjacently located first strut rods 40 are rotatable about an axis line defined by the extended length of rivet member 58. As will be seen in following paragraphs, this type of construction will allow foldability of first strut rods 40 in a manner shown in FIG. 6.

The foldability of support mechanism 34 allows for compactness to be maintained during transportation or storage of modular shelter system 10.

Referring now to FIG. 4, there is shown the coupling elements for adjacently located second strut rods 42. The interface may be similar to that shown in FIG. 4, where second strut rod second end 52 is inserted within groove 62 of a next successive second strut rod 42. Cotter pin 66 is inserted through aligned openings 64 formed within second strut rod first end 50 and a next adjacent second strut rod second end 52. Removable fastening member 68 is inserted through cotter pin 66 to maintain support mechanisms 34 in constrained relation, each to the other, when in use. Thus, a rigid structure between two adjacent support mechanisms 34 is provided by cotter pin 66 on second strut rods 42 and rivet member 58 passing through the appropriate ends of first strut rods 40. When removal is required, removable fastener 68 is removed from cotter pin 66 and cotter pin 66 is removed from through openings 64. Rivet member 58 maintains adjacent first strut rods 40 in coupled relation, but allows pivoting to provide a foldable structure, as is clearly seen in FIG. 6.

As can be seen in FIGS. 2 and 6, first strut rod members 40 and second strut rod members 42 are rigidly secured each to the other on opposing ends through structural rods 70. Structural rods 70 are laterally extendable and are mounted in secured fashion to second end 48 of first strut rod 40 and to second end 52 of second strut rod 42. In this manner, additional rigidity is provided between first strut rod 40 and second strut rod 42 of support mechanisms 44. Structural rods 70 may be joined to strut rods 40 and 42 through welding, bolting, or other like securement mechanism, not important to the inventive concept as is herein described.

As has been previously described, second strut rod 42 of support mechanism 34 is curvilinearly directed and in particular is arcuately contoured having apex portion 72 as is shown in FIGS. 1 and 6. Apex portion 72 is located substantially at the mid-point section of the extended length of second strut rod 42. In this manner, second strut rod 42 is brought into contiguous contact with linearly directed first strut rod 40 at substantially the apex section 72. Further securement of second strut rod 42 to first strut rod 40 is accomplished by weld 74 or some like mechanism which provides a rigid interface and constrainment between first and second strut rods 40 and 42. In this manner, each support mechanism 34 is a rigid structure having load bearing capabilities responsive to the load distributions through both first strut rod member 40 and second strut rod member 42.

Figure 9:
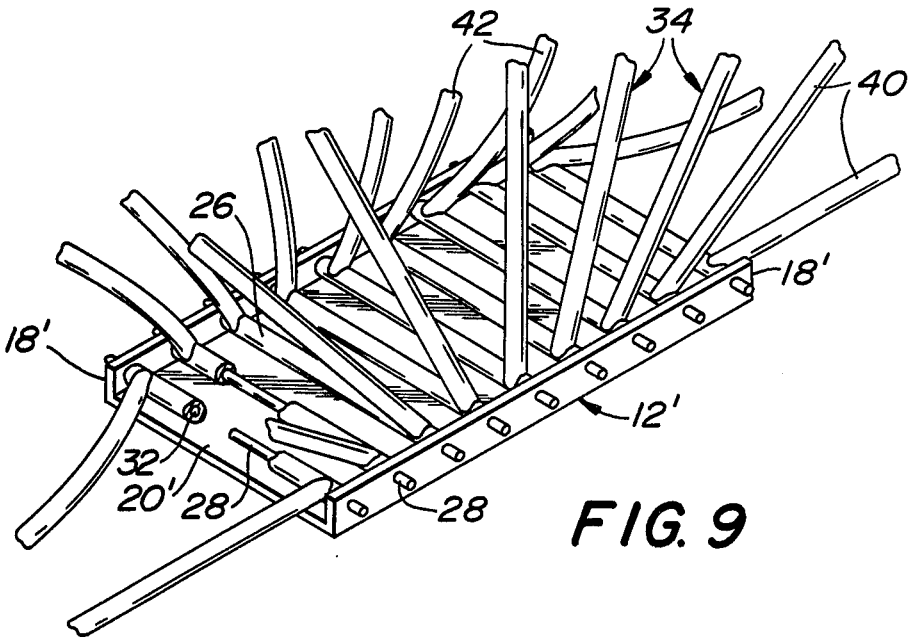

An embodiment of modular shelter system 10 relating to base members 12′ is shown in FIG. 9. In this embodiment, it is seen that base member 12′ continues to have an overall cross-sectional development of a U-shaped contour. However, opposing laterally displaced sidewalls 18′ joined by base floor member 20′ include openings for passage of second rod support members 28 which are linearly directed and not arcuately contoured as is shown in the preferred embodiment of base member 12 in FIG. 8. Sidewalls 18′ are relatively shallow in the vertical direction passing normal to lateral direction 16. However, in this embodiment, various support mechanisms 34 must be of differing lengths in order to provide coupling in the hemispherical envelope, as has previously been described. Thus, in the preferred embodiment, various support mechanisms 34 may be interchanged between sidewall through openings 22 without any particular order. In the case of the embodiment shown in FIG. 9, various support mechanisms 34 are planarly attached and consequently must be inserted within particular through openings to achieve interfacing relationship and resulting in the overall hemispherical contour envelope of modular shelter system 10.

Figure 7:
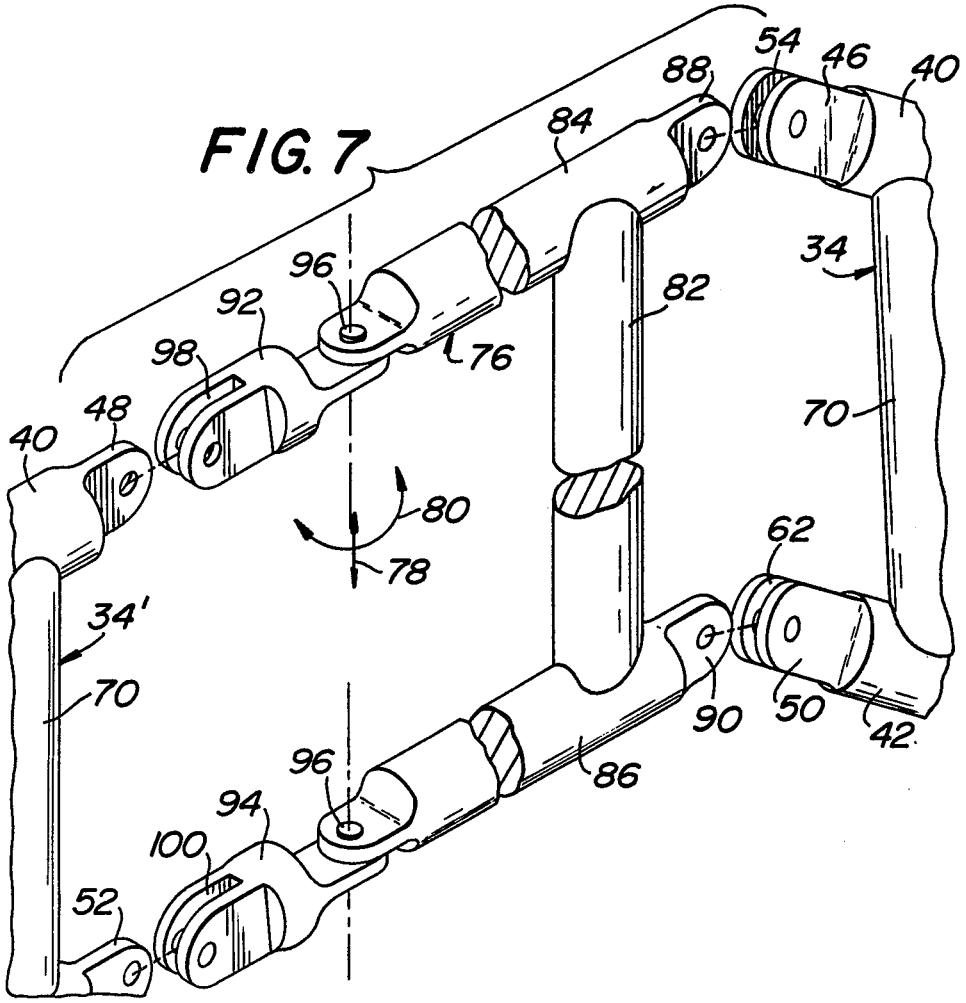
FIG. 7 shows an embodiment of the modular shelter system taken in perspective, providing for a top support mechanism joining adjacently located support mechanisms.
Figure 8:
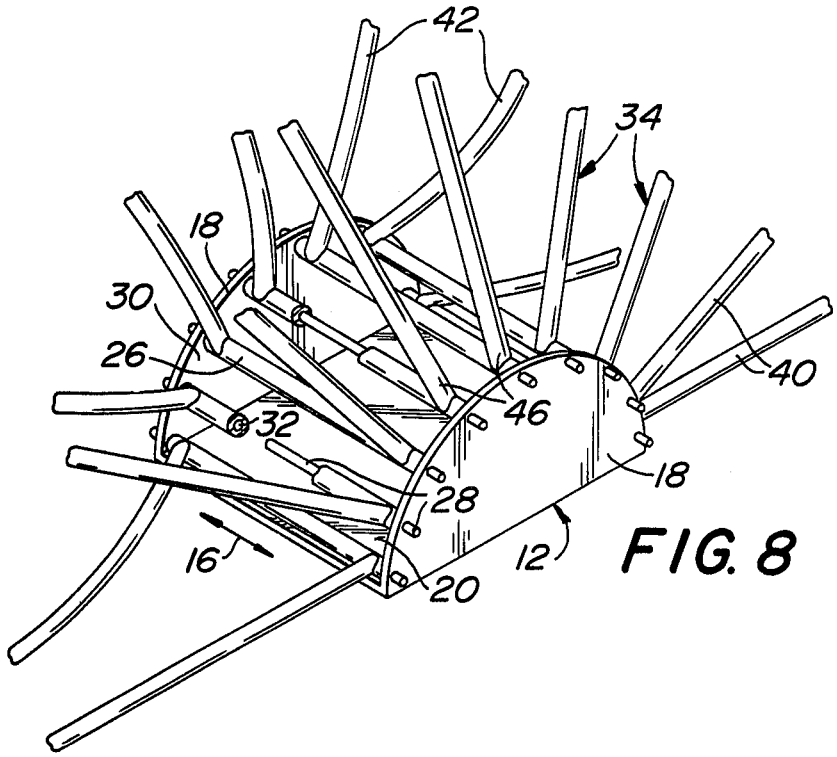
FIG. 8 is an perspective view of a base member of the modular shelter system, showing such base member being joined to the support mechanisms; and, FIG. 9 is an embodiment of the base member taken in perspective, showing the joining of the base member embodiment to a plurality of support mechanisms.

In the embodiments shown in FIGS. 1 and 5, it is seen that four support mechanisms 34 define an entire hemispherical contour. However, in order to increase foldability of modular shelter system 10 and to further provide for additional support mechanisms 34, an embodiment of modular shelter system 10 is shown in FIG. 7, providing for top support mechanism 76. The purpose of top support mechanism 76 is to join a pair of support mechanisms 34 at an upper portion of modular shelter system 10 while allowing both a rotation of various mechanisms 34 about a laterally extending axis and permitting rotation about vertical axis 78 in the direction shown by arcuate arrow 80. As shown in FIG. 7, two support mechanisms 34 and 34′ which would normally be joined each to the other through tongue-in-groove ends 48, 52, and 46, 50 are now joined by top support mechanism 76. As will be described in the following paragraph, the joining of support mechanisms 34 and 34′ to top support mechanism 76 on opposing ends thereof allows for rotation about vertical direction 78.

Top support mechanism 76 includes support bar 82 which is rigidly mounted and secured to first and second top support rods 84 and 86, respectively. In this manner, first and second support bars 84 and 86 are joined in secured fashion, each to the other. First top support bar 84 includes top tongue member 88 insertable within groove 54 of first strut rod first end 46 in the manner shown and described in previous paragraphs. Additionally, lower tongue member 90 is insertable within groove 62 of second strut rod first end 50. Mounting of tongue members 88 and 90 within ends 46 and 50 may be similar to those provided and described in FIGS. 3 and 4.

Upper extension member 92 is pivotally coupled to first top support bar 84 through pivot pin 96. In this manner, upper extension member 92 may be rotationally activated about vertical direction lines 78 in the direction shown by arcuate directional arrow 80. Similarly, lower extension member 94 is joined in pivotal relation to second top support bar 86 through pivot pin 96 to permit identical rotation as is provided by upper extension member 92. Upper extension member 92 and lower extension member 94 include respective grooves 98 and 100. End sections 48 and 52 of support mechanism 34' are then inserted within respective grooves 98 and 100. In this manner, there is provided a two axis of rotation displacement for support mechanisms 34 to allow compact storage or transportation in a folded manner.

Modular shelter system 10 further includes covering member 102 clearly seen in FIGS. 1 and 2. Covering member 102 should be generally formed of a liquid impervious material and may be transparent in nature. In particular, plastic materials have been used to provide a barrier between the internal volume of modular shelter system 10 and the external ambient environment. Covering member 102 may be joined to support mechanisms 34 through a wide variety of fastening couplings. One of such couplings is shown for releasable securement to first strut rods 40. String members 104 shown in FIG. 2 may be secured to an inner surface of covering member 102 and then looped around first strut rods 40. String members 104 may then be tied to provide a securement between first strut rods 40 and covering member 102. Other types of securement may be provided such as a sleeve element being mounted on an internal surface of covering member 102 and respective insert of a portion of strut mechanisms 34. The particular mode and embodiment of securement of covering member 102 to support mechanisms 34 are not restrictive in nature, but must be releasably securable and sufficient in strength to maintain covering member 102 in contiguous contact with support mechanisms 34, responsive to a wide range of variable environmental conditions. Covering member 102 may be mounted to rods 40 in the shown embodiment and would generally be a pre-cut and heat sealed unit in order to repel liquid.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. A modular shelter system comprising:

(a) at least a pair of base members adapted to be locationally mounted on a base surface, said base members being located on opposing sides of said shelter system;

(b) support means being releasably coupled to each of said base members for providing a substantially hemispherical support contour envelope, said support means being foldable;

(c) a covering member adapted to be mounted on said support means, said covering member being securable to said support means; and, (d) base rod support means secured to said support means and extending laterally through a pair of aligned openings formed through a pair of opposing and laterally displaced base member sidewalls, said base rod support means including (1) at least a first rod support member extending in said lateral direction between an inner surface of each of said base member sidewalls, each of said first rod support members having a lateral through opening and a first rod support member external diameter, and (2) at least a second rod support member having an extended length greater than a lateral displacement of said base member sidewalls, each of said second rod support members being insertable through said sidewall aligned openings and each of said first rod support member through openings, each of said second rod support members having a second rod support member diameter.

2. The modular shelter system as recited in claim 1 where at least one of said base members is U-shaped in contour having a base floor member secured to said laterally displaced base member sidewalls.

3. The modular shelter system as recited in claim 2 where each of said base member sidewalls include a plurality of openings formed therethrough, said openings formed in one of said base member sidewalls being aligned in lateral displacement from said openings in said other of said base member sidewalls.

4. The modular shelter system as recited in claim 1 where said support means is captured between said base rod support means and said inner surfaces of said base member sidewalls.

5. The modular shelter system as recited in claim 4 where said support means is slideably mounted on said second rod support member, said support means being constrained between an inner surface of said base member sidewall and a shoulder formed by insert of said second rod support member within said first rod support member through opening.

6. The modular shelter system as recited in claim 1 where said support means includes a first end section and an opposing end section, said first end section being coupled to said base member and said second end section adapted to be joined to a next successive support means.

7. The modular shelter system as recited in claim 6 where said support means includes:

(a) at least a first strut rod being linearly directed having a first end coupled to said base member and a second end adapted to be coupled to a first end of a next successive first strut rod; and, (b) at least a second strut rod being curvilinearly directed having a first end coupled to said base member and a second end adapted to be coupled to a first end of a next successive second strut rod.

8. The modular shelter system as recited in claim 7 where said first strut rod is rigidly secured to said second strut rod, said secured first and second strut rods having laterally displaced first and second ends.

9. The modular shelter system as recited in claim 8 where said second strut rod is arcuately contoured having an apex at substantially a mid-point section of an extended length of said second strut rod.

10. The modular shelter system as recited in claim 9 where said second strut rod is welded to said first strut rod at said apex portion of said second strut rod.

11. The modular shelter system as recited in claim 10 including a lateral strut member secured on opposing ends to said second ends of said first and second strut rods.

12. The modular shelter system as recited in claim 11 where a second end of one of said first strut rods is pivotally coupled to a first end of a next successive first strut rod.

13. The modular shelter system as recited in claim 1 including top support means coupled on opposing ends thereof to said support means for pivotal rotation about a pair of mutually orthogonal axes.

14. The modular shelter system as recited in claim 1 where said covering member is formed of a liquid impervious material.

15. The modular shelter system as recited in claim 14 where said covering member is formed of a substantially transparent material.

16. The modular shelter system as recited in claim 14 where said covering member is formed of a plastic material.

17. The modular shelter system as recited in claim 14 where said covering member is releasably secured to said support means.

18. The modular shelter system as recited in claim 17 including a plurality of string members secured to an inner surface of said covering member and adapted to be tied around said support means.

* * * * *